US011228142B2

(12) United States Patent
Schneider et al.

(10) Patent No.: US 11,228,142 B2
(45) Date of Patent: Jan. 18, 2022

(54) PLUG CONNECTION FOR AUTOMATED COUPLING OF AT LEAST TWO ELECTRICAL CONDUCTORS

(71) Applicant: TE Connectivity Germany GmbH, Bensheim (DE)

(72) Inventors: Felix Schneider, Darmstadt (DE); Dimitrios Mechteridis, Oftersheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/803,100

(22) Filed: Feb. 27, 2020

(65) Prior Publication Data

US 2020/0194934 A1 Jun. 18, 2020

Related U.S. Application Data

(63) Continuation of application No. PCT/EP2018/073046, filed on Aug. 27, 2018.

(30) Foreign Application Priority Data

Aug. 30, 2017 (DE) ..... 102017119896.2

(51) Int. Cl.
*H01R 13/62* (2006.01)
*H01R 13/629* (2006.01)
(Continued)

(52) U.S. Cl.
CPC ..... *H01R 13/62944* (2013.01); *H01R 13/04* (2013.01); *H01R 13/405* (2013.01); *H01R 13/502* (2013.01); *H01R 13/631* (2013.01)

(58) Field of Classification Search
CPC ..... H01R 13/62933; H01R 13/62944; H01R 13/62938; H01R 13/62955; H01R 2107/00
(Continued)

(56) References Cited

U.S. PATENT DOCUMENTS 5,924,880 A 7/1999 Watanabe et al.
7,597,569 B2 * 10/2009 Okuda ..... H01R 13/62955 439/157
(Continued)

FOREIGN PATENT DOCUMENTS

CN 101562297 A 10/2009
DE 8714016 U1 11/1987
(Continued)

OTHER PUBLICATIONS

PCT Notification, International Search Report and The Written Opinion, International Application No. PCT/EP2018/073046, dated Nov. 19, 2018, 15 pages.
(Continued)

*Primary Examiner* — Phuong Chi Thi Nguyen
(74) *Attorney, Agent, or Firm* — Barley Snyder

(57) ABSTRACT

A plug connection for electrically and mechanically coupling a pair of electrical conductors includes a coupling having a coupling housing and a lever with a locking element, a pin strip having a pin strip housing with a recess
(Continued)

receiving the locking element, and a projection arranged between the lever and the pin strip housing. The lever is rotatably mounted at the coupling housing orthogonally to a plug-in direction. The coupling housing is arranged at least in sections on the pin strip housing in a form-fitting manner and the locking element is arranged adjacent to the recess in a pre-locking position of the lever. The locking element is brought into an operative connection with the recess by rotation of the lever. When a plugging force is applied onto the coupling housing, the projection generates a counter force on the lever against the plugging force.

20 Claims, 2 Drawing Sheets

(51) Int. Cl.

| | |
|---|---|
| ***H01R 13/04*** | (2006.01) |
| ***H01R 13/405*** | (2006.01) |
| ***H01R 13/502*** | (2006.01) |
| ***H01R 13/631*** | (2006.01) |

(58) Field of Classification Search
USPC ..... 439/157, 153, 372, 660, 345
See application file for complete search history.

(56) References Cited

U.S. PATENT DOCUMENTS

| | | | | |
|---|---|---|---|---|
| 7,641,486 | B2 * | 1/2010 | Tonosaki ..... | H01R 13/62944 439/157 |
| 9,564,710 | B2 * | 2/2017 | Ebihara ..... | H01R 13/62938 |
| 10,411,405 | B2 * | 9/2019 | Obata ..... | H01R 13/5025 |
| 2009/0075505 | A1 | 3/2009 | Schneider et al. | |

FOREIGN PATENT DOCUMENTS

| | | | |
|---|---|---|---|
| EP | 3016214 | A1 | 5/2016 |
| GB | 2446716 | A | 8/2008 |
| JP | 6399788 | U | 6/1988 |
| WO | 2012176480 | A1 | 12/2012 |

OTHER PUBLICATIONS

The First Office Action dated Sep. 18, 2020 from the CNIPA in Application No. 20180055777.4, 8 pp.
English translation of The First Office Action dated Sep. 18, 2020 from the CNIPA in Application No. 20180055777.4, 8 pp.
Abstract of CN101562297(A), dated Oct. 21, 2009.
Second Office Action dated Mar. 2, 2021 from the CNIPA in Chinese Application No. 201880055777.4, and English translation thereof, 12 pp.
European Patent Office Communication, Application No. 18 765 582.4-1201, dated Sep. 20, 2021, 7 pages.

* cited by examiner

PLUG CONNECTION FOR AUTOMATED COUPLING OF AT LEAST TWO ELECTRICAL CONDUCTORS

CROSS-REFERENCE TO RELATED APPLICATIONS

This application is a continuation of PCT International Application No. PCT/EP2018/073046, filed on Aug. 27, 2018, which claims priority under 35 U.S.C. § 119 to German Patent Application No. 102017119896.2, filed on Aug. 30, 2017.

FIELD OF THE INVENTION

The present invention relates to a plug connection and, more particularly, to a plug connection for electrically and mechanically coupling at least two electrical conductors.

BACKGROUND

In electrical plug connections, a part of the plug connection is usually designed in the form of a pin strip which is connected to a housing or a printed circuit board in a mechanical and electrical manner. A pin strip of this type often has a plurality of pin contacts which can be soldered to conductor paths of a printed circuit board in an electrically conductive manner. The plug connection also usually has a coupling which can be coupled with the pin strip for producing an electrically conductive connection between the pin contacts and bushings arranged in the coupling.

An electrical connection housing with two housing parts, or a pin strip housing and a coupling housing, is disclosed in German Patent Application No. DE 8714016 U1, for example. The pin strip housing has two lever arms for executing a pivoting movement which is oriented transverse to a plug-in direction. The lever arms have several teeth for engaging in a form-fitting manner in two toothed rods arranged at the coupling housing. By operating the lever, in a second step the coupling housing which was previously positioned in a pre-locking position can be plugged into a final locking position and thus enter into a mechanical connection with the pin strip housing. The housing parts are designed to be manually connected to one another or released from one another in a confined environment.

When assembling a coupling or a coupling housing in a pin strip housing, the coupling housing usually had to be fitted with the lever located in the pre-locking position, and then manually guided via the positioning of the pre-locking position as far as the final locking position of the lever in order to connect the coupling housing to the pin strip housing. The coupling consequently cannot be fitted onto a pin strip housing quickly and the fitting requires significant effort.

SUMMARY

A plug connection for electrically and mechanically coupling a pair of electrical conductors includes a coupling having a coupling housing and a lever with a locking element, a pin strip having a pin strip housing with a recess receiving the locking element, and a projection arranged between the lever and the pin strip housing. The lever is rotatably mounted at the coupling housing orthogonally to a plug-in direction. The coupling housing is arranged at least in sections on the pin strip housing in a form-fitting manner and the locking element is arranged adjacent to the recess in a pre-locking position of the lever. The locking element is brought into an operative connection with the recess by rotation of the lever. When a plugging force is applied onto the coupling housing, the projection generates a counter force on the lever against the plugging force.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
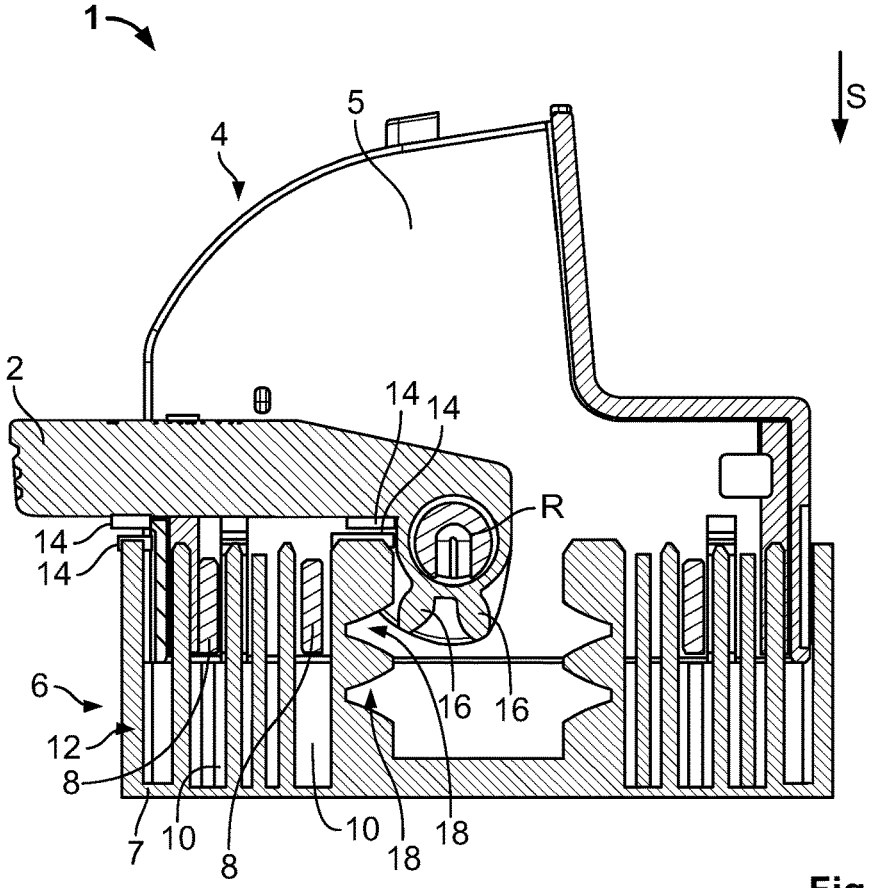
FIG. 1 is a sectional side view of a plug connection according to an embodiment in a pre-locking position of a lever.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. Furthermore, several aspects of the embodiments may form—individually or in different combinations—solutions according to the present invention. The following described embodiments thus can be considered either alone or in an arbitrary combination thereof.

A plug connection 1 according to an embodiment is shown in FIG. 1 with a lever 2 in a pre-locking position. For the sake of simplicity, electrical conductors with corresponding pin contacts and bushing elements are not shown in FIG. 1.

The plug connection 1, as shown in FIG. 1, has a coupling 4 and a pin strip 6. The coupling 4 has a coupling housing 5 which can be inserted into a pin strip housing 7 of the pin strip 6. The plug connection 1 has a rectangular cross-section in the shown embodiment. The lever 2 has a U-shape and is guided around the coupling housing 5, the lever 2 being rotatably connected to the coupling housing 5 on a pair of opposite sides around the rotation axis R.

The pin strip 6 can be arranged at a housing or on a printed circuit board and have an electrically conductive connection to conductor paths or electrical conductors. The coupling 4 is, for example, connected to a multi-core conductor in an electrically conductive and mechanical manner. The multi-core conductor can be coupled to a plurality of pin contacts of the pin strip 6 in an electrical and mechanical manner by the coupling 4.

When the coupling housing 5 is in the state inserted in the pin strip housing 7, the pin strip housing 7 surrounds the coupling housing 5 on all sides. As shown in the embodiment of FIG. 1, the coupling housing 5 has a plurality of guide elements 8. The pin strip housing 7 has a plurality of gaps 10 which correspond to the guide elements 8.

In the case of a mating of the coupling 4 with the pin strip 6, the guide elements 8 can be slid in a guided manner through the gaps 10 and thus enable a precise, linear mating of the plug connection 1, as shown in FIG. 1. According to the exemplary embodiment, the pin strip housing 7 is designed in sections in the form of a plurality of ribs 12. The gaps 10 are designed as defined spacings for receiving the guide elements 8.

In the embodiment shown in FIG. 1, a plurality of projections 14 are arranged on the lever 2. The projections 14 are arranged on a side of the lever 2 facing the pin strip housing 7. On the pin strip housing 7, projections 14 are also arranged on a side facing the lever 2. The projections 14 can be positioned at an end side on a housing wall or the ribs 12. The projections 14 on the lever 2 and the pin strip housing 7 are positioned here such that they are arranged in succession in a pre-locking position of the lever 2. The projections 14 can be fixed or adhered to the lever 2 in a mechanical or cohesive manner or, in another embodiment, the projections 14 can be formed integrally with the lever 2, such as in a mold. The projections 14 can be adhered, welded, screwed, or locked on the pin strip housing 7 in various embodiments. In another embodiment, the projections 14 can be formed integrally with the pin strip housing 7, for example, as an elongated rib or a bulge from the pin strip housing 7.

The lever 2 is connected in a rotatable manner to the coupling housing 5. The lever 2 has a rotation axis R, shown in FIG. 1, which is orientated orthogonal relative to a plug-in direction S of the coupling 4. The lever 2 has a pair of locking elements 16 in the region of the rotation axis R. The locking elements 16 are designed in the form of a plurality of teeth of a toothed gear segment. In the pre-locking position of the lever 2 shown in FIG. 1, with the lever 2 at a defined rotation angle, the locking elements 16 are arranged angled such that the locking elements 16 can pass by a plurality of recesses 18 of the pin strip housing 7 without any interaction. The locking elements 16 do not interact with the recesses 18 when the lever 2 is at the defined rotation angle.

The recesses 18 of the pin strip housing 7, as shown in FIG. 1, are formed as a plurality of tooth spacings of a toothed rod segment and are oriented orthogonal relative to the plug-in direction S and the rotation axis R. In the pre-locking position of the lever 2, the locking elements 16 can be brought into form-fitting engagement with the recesses 18 by a rotation of the lever 2.

Figure 2A:
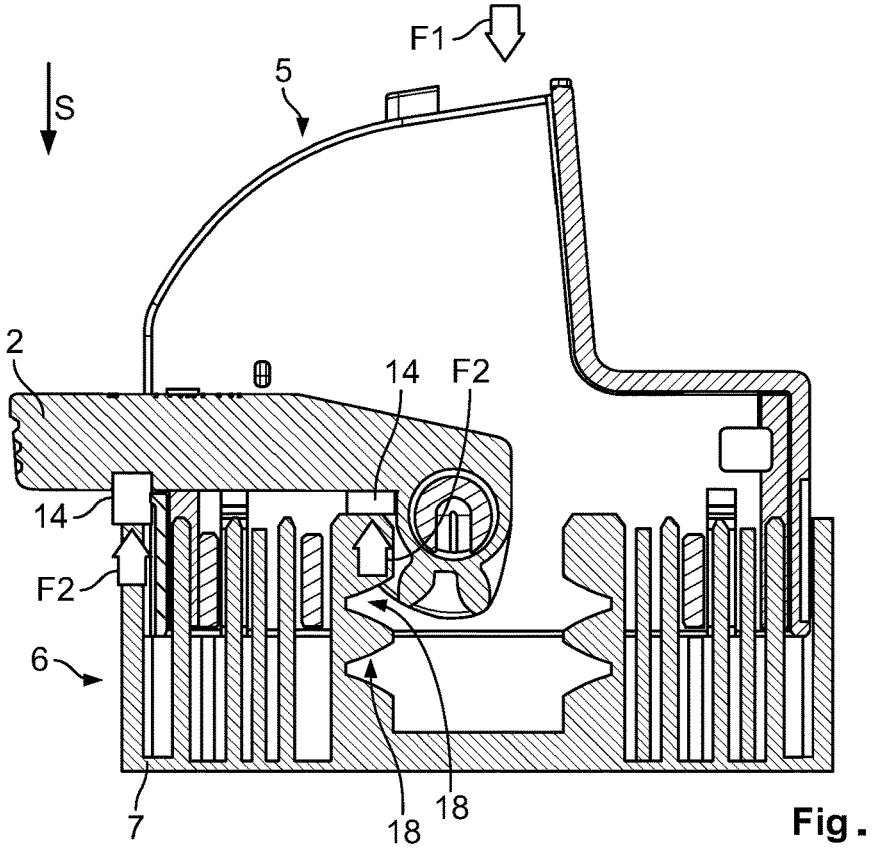
FIG. 2A is a sectional side view of the plug connection in the pre-locking position when applying a plugging force onto a coupling housing.
Figure 2B:
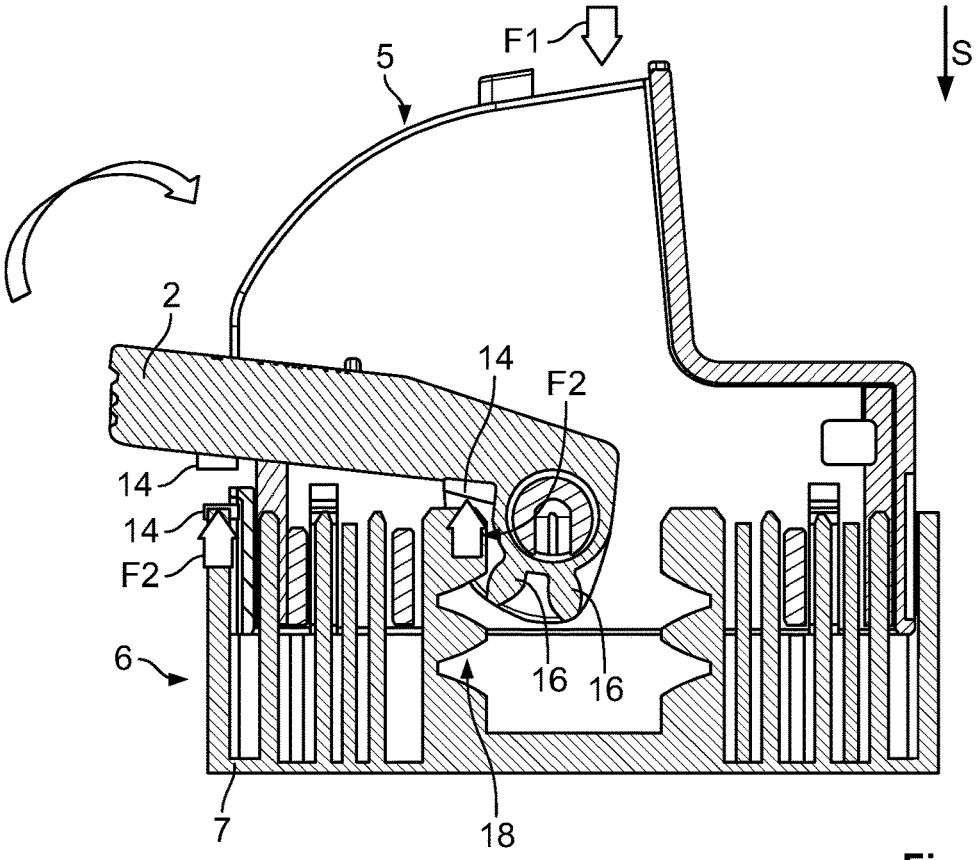
FIG. 2B is a sectional side view of the plug connection with an initial rotation when applying the plugging force.

FIGS. 2A and 2B show the plug connections 1 according to the exemplary embodiment in a pre-locking position of the lever 2 when a plugging force F1 directed in the plug-in direction S is being applied onto the coupling housing 5. In particular, the mode of action of the projections 14 is illustrated.

The coupling housing 5 is introduced further into the pin strip housing 7 by applying the plugging force F1 in the plug-in direction S, as shown in FIG. 2A. The projections 14 situated one after another in the pre-locking position of the lever 2 generate on the lever 2 a counter force F2 which is directed against the plugging force F1. As a result, the lever 2 can be diverted or rotated in the direction of a final locking position by the interaction of the projections 14. The final locking position of the lever 2 is rotated about a rotation angle of approximately 90° relative to the pre-locking position and is explained in greater detail in FIG. 3.

The at least one projection 14 is designed to be rigid or flexible. Depending on the requirements for the plug connection 1, the at least one projection 14 can consist of a flexible material such that a defined spring behavior of the lever 2 can be realized when applying the plugging force F1. A rigidly designed projection 14 can be arranged in a technically simple manner on the lever 2 or the pin strip housing 7. A rigidly designed projection 14 can be used when producing the lever 2 or the pin strip housing 7 by an injection molding method.

By rotating the lever 2 in the direction of the final locking position, by virtue of the counter force F2 generated by interaction of the projections 14, as shown in FIG. 2B, the locking elements 16 can be rotated such that the locking elements 16 of the lever 2 can interact with the recesses 18 of the pin strip housing 7 in a form-fitting manner. In another embodiment, the locking elements 16 are connected to the recesses 18 in a force-fitting or a frictional manner in the final locking position.

If the plugging force F1 is furthermore exerted onto the coupling housing 5, the lever 2 can be further rotated by virtue of the displacement of the locking elements 16 relative to the recesses 18 of the pin strip housing 7. In a first step, the projections 14 can thus bring the locking elements 16 and the recesses 18 into an operative connection such that, in a second step, by way of the operative connection of the locking elements 16 and the recesses 18, the lever 2 can be further rotated at least in the direction of the final locking position in the case of an exerted plugging force F1. The first step takes place by virtue of a relative movement of the coupling housing 5 or of the lever 2 relative to the pin strip housing 7. In the second step, the rotation of the lever 2 takes place by the relative movement between the locking elements 16 and the recesses 18 of the pin strip housing 7.

Figure 3:
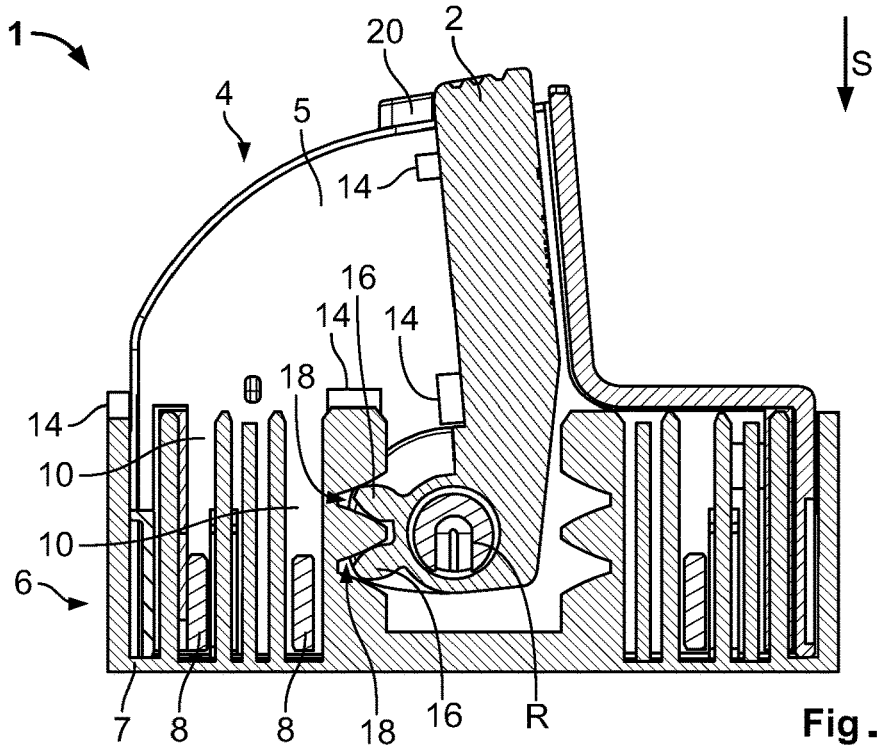
FIG. 3 is a sectional side view of the plug connection in a final locking position of the lever.

The plug connection 1 is shown in a final locking position of the lever 2 in FIG. 3. By mating the coupling housing 5 and the pin strip housing 7, the lever 2 can simultaneously be rotated into the final locking position. In the final locking position of the lever 2, the projections 14 are spaced apart from one another, and all locking elements 16 are connected to all recesses 18 of the pin strip housing 7 in a form-fitting manner. As a result of this, an unintended separation of the coupling 4 from the pin strip 6 can be prevented.

In the final locking position of the lever 2 shown in FIG. 3, the lever 2 is secured against undesired movements by an additional securing element 20. The securing element 20 is a locking nipple in the shown embodiment. The lever 2 can lock in the final locking position by way of the securing element 20. As a result, the lever 2 being released and rotated in the direction of the pre-locking position, for example by vibrations, can be prevented. The lever 2 must be released with a torque defined by the securing element 20 in order to be rotated into the pre-locking position. In the embodiment shown in FIG. 3, the securing element 20 is a locking hook 20 which can be pressed in by an operating force in order to release the lever 2. The plug connection 1 thus has several safeguards against vibrations and mechanical influences.

The plug connection 1 can be both connected and locked in place in particular in an automated manner by applying the plugging force F1 in the plug-in direction S, such that a manual moving of the lever 2 into the final locking position may be omitted.

In an embodiment, the lever 2 can be designed to be bistable, for example, such that a raising of the lever 2 from the pre-locking position results in an independent moving of the lever 2 into the final locking position. For this purpose, the lever 2 can be connected to a restoring spring, for example, the restoring spring being able to act on a point of the lever 2 which is spaced apart from the rotation axis R of the lever, and said restoring spring being able to attract or repel the lever 2 into the final locking position.

The counter force F2 which can be generated is particularly dependent on the applied plugging force F1 and the position of the at least one projection 14. By virtue of the counter force F2 which can be generated in the region of the lever 2 and the resultant lever action, the counter force F2 can be relatively low for effecting a movement of the lever 2. By contrast, a counter force acting in the region of the rotation axis R must be higher, whereby the coupling housing 5 or the printed circuit board connected to the pin strip housing 7 can be damaged in the case of a higher plugging force F1. The at least one projection 14 is thus spaced as far apart as possible from the rotation axis R of the lever 2 such that a counter force acting on the lever 2 and potential damage to the coupling housing 5 or to the pin strip housing 7 can be reduced.

By rotating the lever 2 back into the pre-locking position, the coupling housing 5 can be spaced apart from the pin strip housing 7 against the plug-in direction S by the interaction of the at least one locking element 16 and the at least one recess 18. As a result of this, a releasing of the plug connection 1 by spacing the coupling housing 5 apart from the pin strip housing 7 can be simplified. In particular, the releasing can be simplified by operating the lever 2 such that damage to the coupling 4 or the pin strip 6 can be avoided. To release, the lever 2 must only be rotated from a final locking position into a pre-locking position. By virtue of the lever action, a lower force must be applied to move the lever 2, as a result of which the respective components of the plug connection 1 are put under less mechanical stress.

What is claimed is:

1. A plug connection for electrically and mechanically coupling a pair of electrical conductors, comprising:

a coupling having a coupling housing and a lever with a locking element, the lever rotatably mounted at the coupling housing orthogonally to a plug-in direction;

a pin strip having a pin strip housing with a recess receiving the locking element, the coupling housing is arranged at least in sections on the pin strip housing in a form-fitting manner and the locking element is arranged adjacent to and disengaged from the recess in a pre-locking position of the lever, the locking element is brought into an operative connection with the recess by rotation of the lever out of the pre-locking position; and a projection arranged on at least one of the lever or the pin strip housing between the lever and the pin strip housing at a position remote from the locking element and the recess, when a plugging force is applied onto the coupling housing with the lever in the pre-locking position, contact on the projection by at least one of the lever or the pin strip housing generates a counter force on the lever against the plugging force for rotating the lever and engaging the locking element in the recess.

2. The plug connection of claim 1, wherein the locking element is a tooth of a toothed gear segment.

3. The plug connection of claim 1, wherein the recess is a tooth spacing of a toothed rod segment.

4. The plug connection of claim 1, wherein, by rotating the lever from the final locking position and toward the pre-locking position, the coupling housing is spaced apart from the pin strip housing against the plug-in direction through interaction of the locking element and the recess, and wherein, with the locking element disengaged from the recess, further rotation of the lever into the pre-locking position abuts the projection against at least one of the lever or the pin strip housing and further separates the coupling housing and the pin strip housing.

5. The plug connection of claim 1, further comprising another projection arranged on at least one of the lever and the pin strip housing between the lever and the pin strip housing at a position proximal to the locking element and the recess, wherein the projection is arranged at a position distal to the locking element and the recess.

6. The plug connection of claim 1, wherein the projection is arranged on the lever and defines a contact surface facing in the plug-in direction of the coupling housing, the contact surface contacting the pin strip housing in the pre-locking position of the lever.

7. The plug connection of claim 6, further comprising another projection arranged on the pin strip housing and having a contact surface opposing the contract surface of the projection in the plug-in direction of the coupling housing, the projection contacting the another projection in the pre-locking position of the lever to generate the counter force.

8. The plug connection of claim 1, wherein the projection is arranged on the pin strip housing and defines a contact surface opposing the lever in the plug-in direction of the coupling housing, the contact surface contacting the lever in the pre-locking position of the lever.

9. The plug connection of claim 8, wherein the projection is arranged on a free end of a sidewall of the pin strip housing.

10. The plug connection of claim 1, wherein the lever is rotatable in a direction of a final locking position by the counter force.

11. The plug connection of claim 10, wherein the lever is rotatable into the final locking position by the counter force.

12. The plug connection of claim 10, wherein the lever is rotatable into the final locking position by the counter force and an engagement of the locking element in the recess.

13. The plug connection of claim 10, wherein the coupling housing is locked on the pin strip housing in the final locking position by a securing element formed on the coupling housing and engaging with a free end of the lever.

14. A plug connection for electrically and mechanically coupling a pair of electrical conductors, comprising:

a coupling including:

a coupling housing; and a lever rotatably mounted to the coupling housing about an axis oriented orthogonal to a plug-in direction of the coupling, the lever defining a locking element on a first end thereof;

a pin strip having a pin strip housing receiving the coupling housing in the plug-in direction and defining a recess for receiving the locking element, with the coupling housing partially received within the pin strip housing and the lever in a pre-locking position, the locking element is arranged adjacent to and disengaged from the recess, the locking element engaging with the recess by rotating the lever out of the pre-locking position as the coupling housing is further received within the pin strip housing; and a first projection arranged on at least one of the lever or the pin strip housing and between the lever and the pin strip housing at a position remote from the locking element and the recess, wherein, when a plugging force is applied onto the coupling housing with the lever in the pre- locking position, contact between the projection and at least one of the lever or the pin strip housing generates a counter force on the lever against the plugging force for rotating the lever out of the pre-locking position and engaging the locking element with the recess.

15. The plug connection of claim 14, further comprising a second projection arranged on the other one of the lever or the pin strip housing, the first and second projections in opposing contact with one another in the plug-in direction with the lever in the pre-locking position.

16. The plug connection of claim 14, wherein the coupling housing is locked on the pin strip housing in a final locking position of the lever by a securing element protruding from the coupling housing and engaging with an underside surface of the lever.

17. The plug connection of claim 14, wherein the first projection comprises a first pair of projections extending from the lever, each of the pair of projections spaced apart from one another along a length of the lever.

18. The plug connection of claim 17, wherein each of the first pair of projections extends from an underside surface of the lever and defines a contact surface contacting the pin strip housing in the plug-in direction with the lever in the pre-locking position.

19. The plug connection of claim 14, further comprising a pair of second projections arranged on the pin strip housing, each of the pair of second projections in opposing contact with a respective one of the first pair of projections.

20. The plug connection of claim 19, wherein a first one of the second pair of projections is formed on a free end of a sidewall of the pin strip housing, and a second one of the second pair of projections is formed on a free end of a portion of the pin strip housing defining the recess, each of the second pair of projections defining a contact surface opposing a contact surface of a respective one of the first pair of projections in the plug-in direction with the lever in the pre-locking position.

* * * * *